US011707395B2

(12) United States Patent
White et al.

(10) Patent No.: US 11,707,395 B2
(45) Date of Patent: Jul. 25, 2023

(54) KNEE POSITIONING SYSTEM WITH CLEANOUT CHANNEL

(71) Applicant: White Surgical, Inc., Fort Wayne, IN (US)

(72) Inventors: Stephen E. White, Fort Wayne, IN (US); Roy Wiley, Warsaw, IN (US)

(73) Assignee: White Surgical, Inc., Fort Wayne, IN (US)

( * ) Notice: Subject to any disclaimer, the term of this patent is extended or adjusted under 35 U.S.C. 154(b) by 33 days.

(21) Appl. No.: 16/887,918

(22) Filed: May 29, 2020

(65) Prior Publication Data

US 2021/0369528 A1 Dec. 2, 2021

(51) Int. Cl.
*A61G 13/00* (2006.01)
*A61G 13/12* (2006.01)

(52) U.S. Cl.
CPC ..... *A61G 13/0063* (2016.11); *A61G 13/129* (2013.01); *A61G 13/1245* (2013.01)

(58) Field of Classification Search
CPC ..... A61F 5/37; A61F 5/3761; A61F 5/3769; A61F 5/3792; A61F 5/0585; A61F 5/05858; A61F 5/058; A61G 7/075; A61G 7/0755; A61G 7/1082; A61G 7/109; A61G 7/1092; A61G 7/1096; A61G 7/1098; A61G 7/065; A61G 13/10; A61G 13/12; A61G 13/1235; A61G 13/1245; A61G 13/1255; A61G 13/1285; A61G 13/128; A61G 13/129; A61G 13/101; A61G 13/125; A61G 13/0063
USPC ..... 128/845
See application file for complete search history.

(56) References Cited

U.S. PATENT DOCUMENTS

| | | | | |
|---|---|---|---|---|
| 2,581,110 | A | 1/1952 | Kenworthy | |
| 2,666,430 | A * | 1/1954 | Gispert | A61B 17/1703 606/96 |
| 3,234,623 | A * | 2/1966 | Rector | A61G 13/1205 27/21.1 |
| 4,136,858 | A | 1/1979 | Petersen | |
| 4,323,080 | A * | 4/1982 | Melhart | A61B 6/505 128/882 |
| 4,615,516 | A | 10/1986 | Stullberg et al. | |
| 4,846,173 | A * | 7/1989 | Davidson | A61B 90/14 378/208 |
| 5,166,968 | A * | 11/1992 | Morse | A61B 6/04 378/177 |
| 5,799,349 | A * | 9/1998 | Petersen | A61G 13/0063 5/624 |
| 8,636,744 | B2 | 1/2014 | Tochigi et al. | |

OTHER PUBLICATIONS

Brochure for Alvarado II, Knee Positioner, White Surgical Inc., first date of sale Jun. 3, 2019 (2 pages).

* cited by examiner

*Primary Examiner* — Adam Baker
(74) *Attorney, Agent, or Firm* — Taylor IP, P.C.

(57) ABSTRACT

A rail assembly for a knee positioning system that includes a base and a pair of rails removably coupled to the base. Each of the rails defines a plurality of positioning slots formed therein, each of the positioning slots being at least partially aligned with a corresponding positioning slot of the other rail. At least one of the rails and the base form at least one cleanout channel therebetween that is configured to receive a cleaning fluid for removing contaminants that collect on the at least one rail and the base.

12 Claims, 5 Drawing Sheets

KNEE POSITIONING SYSTEM WITH CLEANOUT CHANNEL

BACKGROUND OF THE INVENTION

1. Field of the Invention

The present invention relates to orthopaedic surgery devices, and, more particularly, to knee positioning systems.

2. Description of the Related Art

Knee positioning systems are often used to hold a patient's knee in a desired position during an orthopaedic procedure, such as during surgery. A typical knee positioning system includes a boot that holds the patient's foot and leg and is adjustably coupled to a base. Adjustment of the boot on the base adjusts the positioning and orientation of the patient's foot and leg, and thus the knee, during the procedure.

Many known knee positioning systems are re-usable. When the knee positioning system is re-usable, cleaning and sterilization are important considerations. Ineffective cleaning and/or sterilization can expose patients to harmful contaminants and/or pathogens.

What is needed in the art is a knee positioning system that can be effectively cleaned and sterilized.

SUMMARY OF THE INVENTION

The present invention provides a knee positioning system with a rail assembly having a cleanout channel that is defined between a rail and a base of the rail assembly and is configured to receive a cleaning fluid for removing contaminants that collect on the rail and the base.

The invention in one form is directed to a rail assembly for a knee positioning system that includes a base and a pair of rails removably coupled to the base. Each of the rails defines a plurality of positioning slots formed therein, each of the positioning slots being at least partially aligned with a corresponding positioning slot of the other rail. At least one of the rails and the base form at least one cleanout channel therebetween that is configured to receive a cleaning fluid for removing contaminants that collect on the at least one rail and the base.

The invention in another form is directed to a knee positioning system including a rail assembly having a base and a pair of rails removably coupled to the base. Each of the rails defines a plurality of positioning slots formed therein. Each of the positioning slots is at least partially aligned with a corresponding positioning slot of the other rail. At least one of the rails and the base form at least one cleanout channel therebetween that is configured to receive a cleaning fluid for removing contaminants that collect on the at least one rail and the base. A boot includes a leg portion, a foot portion coupled to the leg portion, and a positioning pin slidably received in a pair of corresponding positioning slots of the rails.

A possible advantage that may be realized by exemplary embodiments provided according to the present invention is that the cleanout channel(s) provides an area where contaminants tend to collect but is large enough to receive a cleaning fluid and/or brush bristles that can wash out the contaminants.

Another advantage is the rails can be removably coupled to the base in a fluid-tight manner so contaminants are only able to collect in the cleanout channel(s), which is exposed for easy cleaning, while reducing the number of small crevices that form between the rails and the base.

Yet another advantage is the rails can be removed from the base if a more thorough cleaning and/or sterilization is desired.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
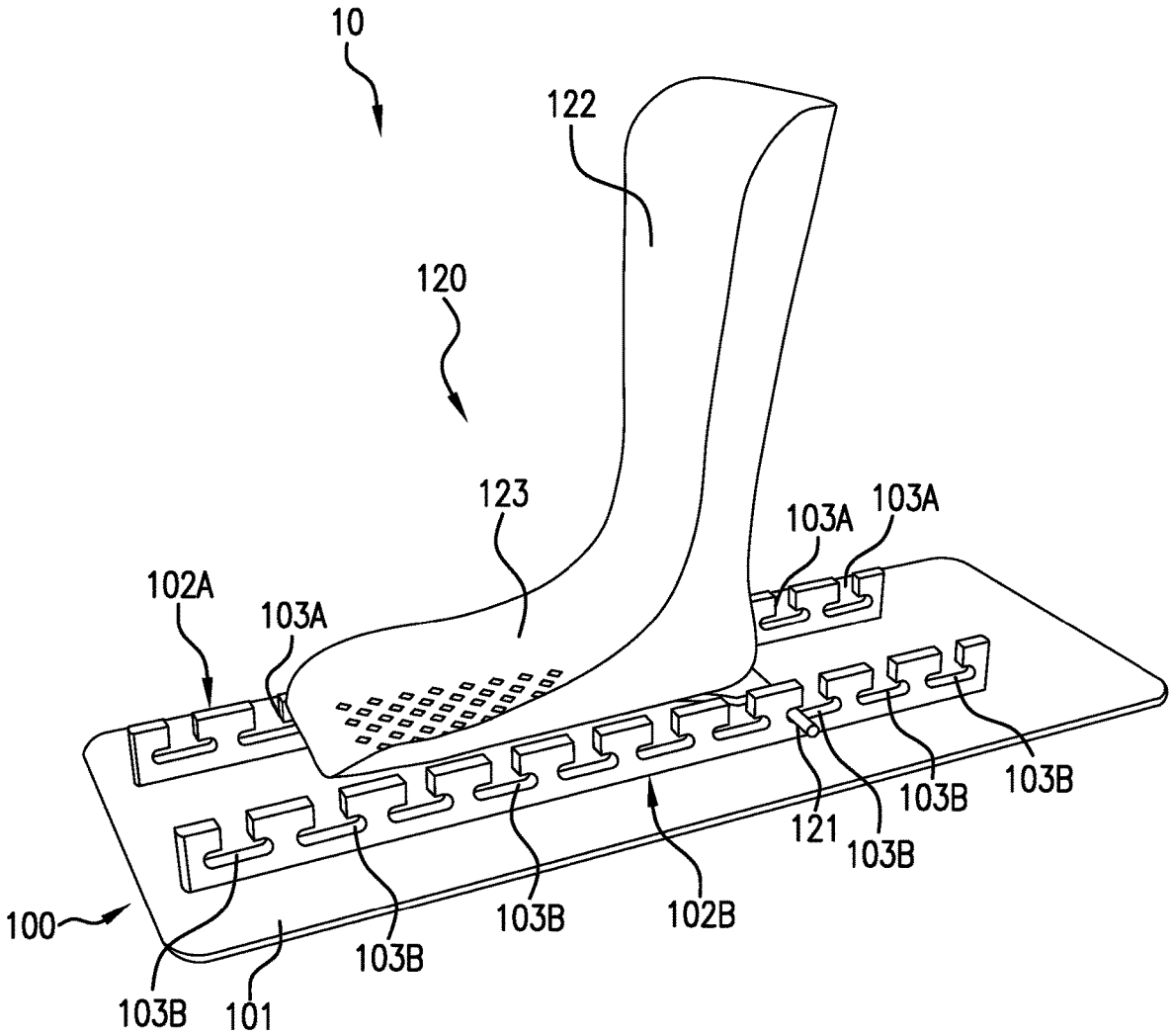
FIG. 1 Prior Art
FIG. 1 is a perspective view of a knee positioning system that includes a boot and a rail assembly provided according to the prior art.

Referring now to the drawings, and more particularly to FIG. 1, there is shown a known knee positioning system 10 which generally includes a rail assembly 100 and a boot 120 coupled to the rail assembly 100. The illustrated knee positioning system 10 is commonly referred to as an ALVARADO® style knee positioning system or knee positioner. The rail assembly 100 includes a base 101, which may be a generally planar baseplate comprising a metal, and a pair of rails 102A, 102B coupled to the base 101. Each of the rails 102A, 102B defines a plurality of positioning slots 103A, 103B. The positioning slots 103A of the rail 102A are each aligned with a corresponding slot 103B of the rail 102B so a positioning pin 121 of the boot 120 can be slidably received in a pair of positioning slots 103A, 103B to position and orient the boot 120. The positioning pin 121 may also, for example, pivot within the positioning slots 103A, 103B to change the angular orientation of the boot 120. The boot 120 includes a leg portion 122 that is configured to receive a portion of a patient's leg, such as the calf and ankle, and a foot portion 123 that is coupled to the leg portion 122 and configured to receive a patient's foot. By holding a patient's leg in the boot 120, the patient's leg can be held in a fixed position.

It has been found that known knee positioning systems, while effective for holding knees during procedures, are difficult to clean. As can be seen in FIG. 1, the rails 102A, 102B are each mounted to the base 101 across their entire length. The region between the bottoms of the rails 102A, 102B and the base 101 provides a potential collection area for contaminants, such as biological fluids, because the rails 102A, 102B and the base 101 are not completely planar. The small regions between the rails 102A, 102B and the base 101 can also harbor potentially infectious pathogens, such as the virus that causes COVID-19. Due to the relatively small size of these regions, it is difficult to effectively clean the rail assembly 100 while the rails 102A, 102B are mounted to the base 101. Further, it is difficult to see if there are collected contaminants in the small regions between the rails 102A, 102B and the base 101, which makes it difficult to determine if a more rigorous cleaning is warranted. Thus, normal cleaning procedures for the rail assembly 100 include uncoupling the rails 102A, 102B from the base 101 before cleaning and sterilizing the individual components. While this cleaning procedure effectively cleans and sterilizes the base 101 and the rails 102A, 102B, it is time consuming to remove and replace the rails 102A, 102B from the base 101 each time the rail assembly 100 is cleaned and sterilized.

Figure 2:
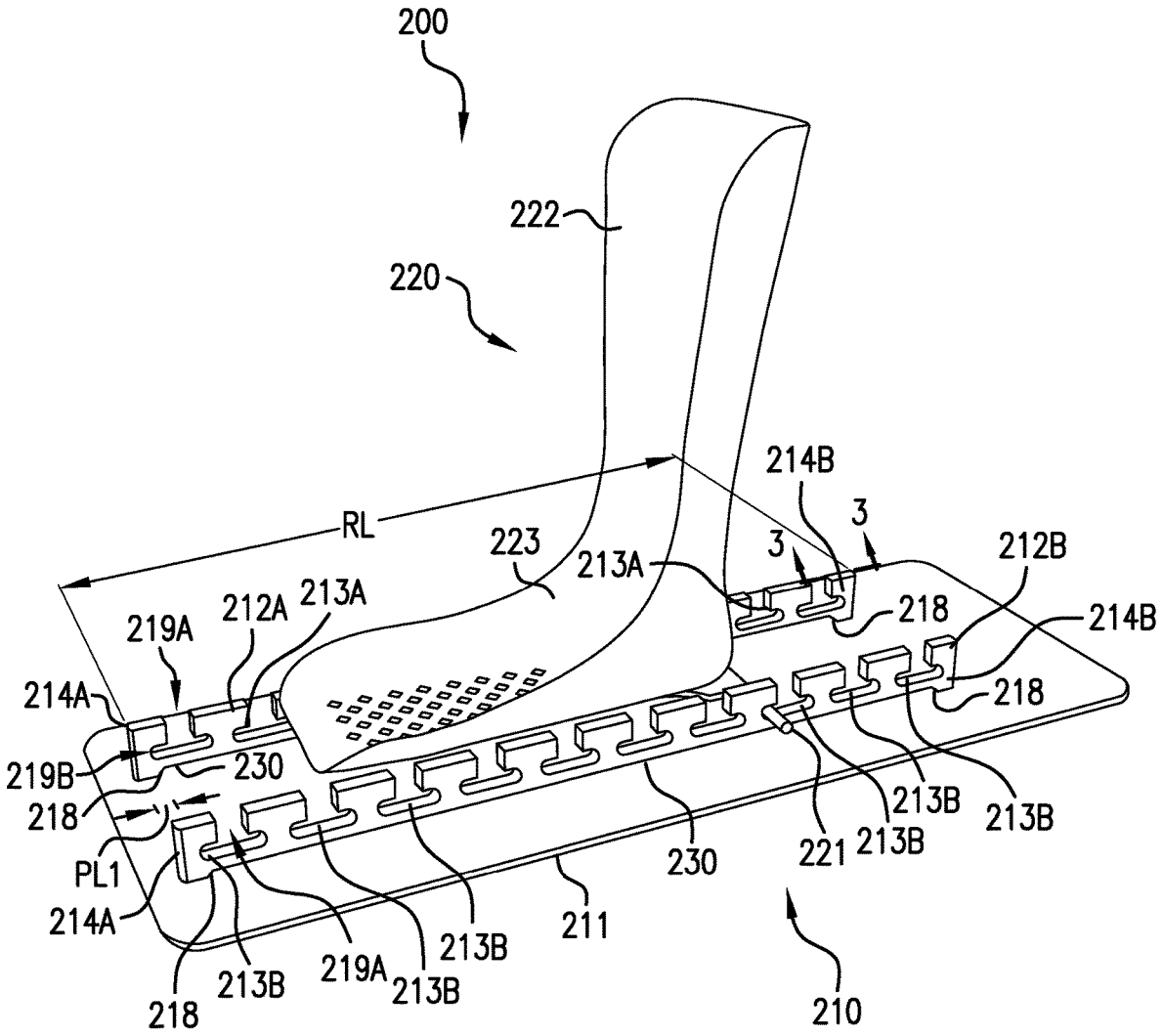
FIG. 2 is a perspective view of an exemplary embodiment of a knee positioning system including a boot and a rail assembly with a cleanout channel, provided in accordance with the present invention.
Figure 3:
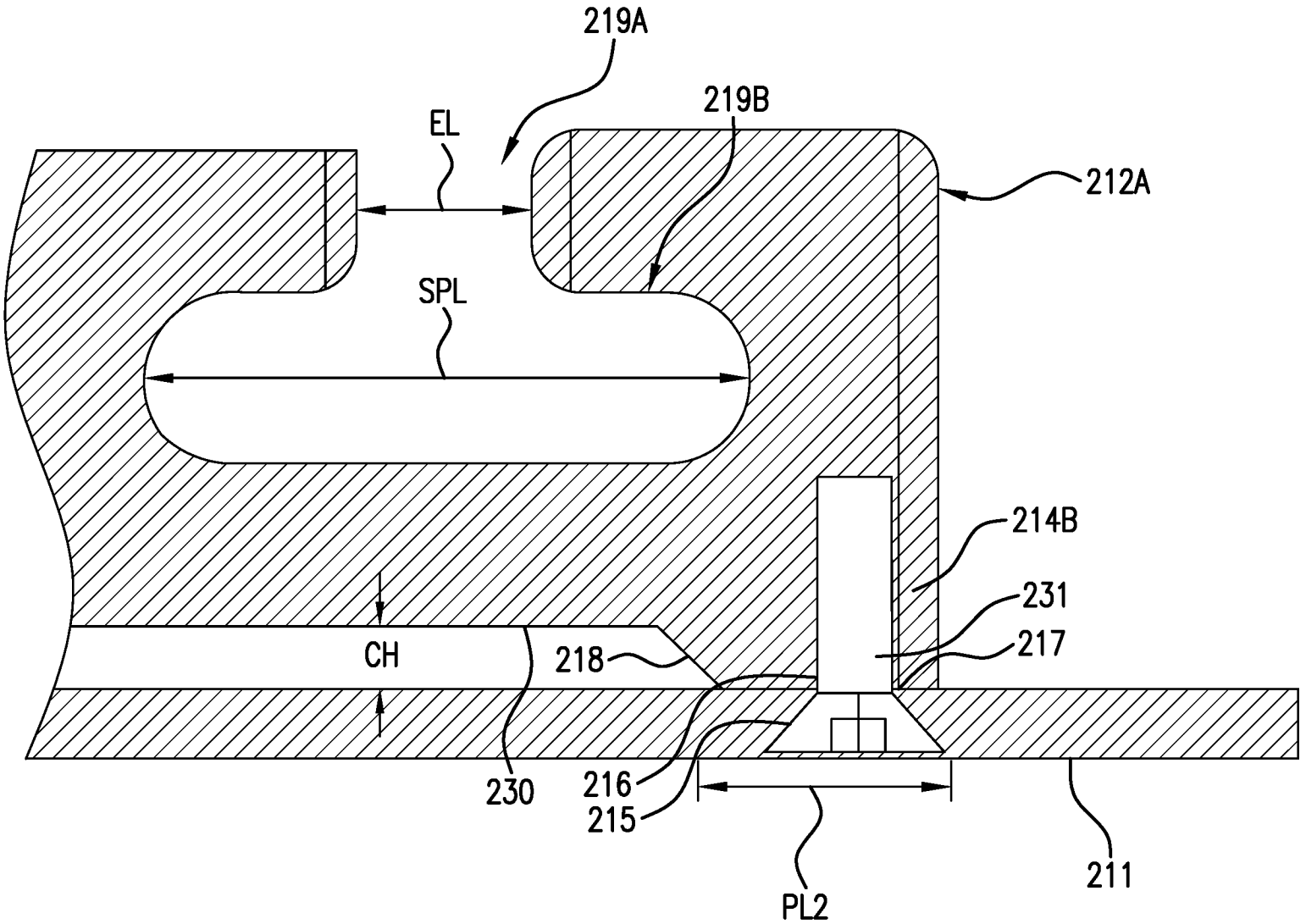
FIG. 3 is a cross-sectional view of the rail assembly illustrated in FIG. 2 taken along line 3-3.

To address some of the previously described issues, and referring now to FIGS. 2 and 3, a knee positioning system 200 provided according to the present invention includes a rail assembly 210 and a boot 220. The rail assembly 210 includes a base 211 and a pair of rails 212A, 212B that are removably coupled to the base 211. As used herein, the rails 212A, 212B are "removably" coupled to the base 211 in the sense that the rails 212A, 212B can be removed from the base 211 without significant damage to either the rails 212A, 212B or the base 211, i.e., the rail assembly 210 is a modular assembly of the rails 212A, 212B and the base 211. The base 211 may be, for example, a planar plate comprising a metal such as stainless steel. Each of the rails 212A, 212B defines a plurality of positioning slots 213A, 213B formed therein. The positioning slots 213A, 213B are each at least partially aligned with a corresponding positioning slot 213B, 213A of the other rail 212A, 212B so the positioning slots 213A, 213B define aligned pairs of positioning slots 213A, 213B to slidably receive a positioning pin 221 of the boot 220. In some embodiments, the rails 212A, 212B extend in parallel to each other and the positioning slots 213A, 213B are fully aligned so an entirety of each of the positioning slots 213A, 213B is co-axial with its corresponding positioning slot 213A, 213B of the other rail 212A, 212B.

Similarly to the previously described boot 120, the boot 220 includes a leg portion 222 configured to hold at least a portion of a patient's leg and a foot portion 223 that is coupled to the leg portion 222 and is configured to hold at least a portion of a patient's foot. The leg portion 222 and the foot portion 223 may be connected to one another so the boot 220 is substantially L-shaped, as is known. The positioning pin 221 of the boot 220 may be coupled, for example, to a portion of the boot 220 where the leg portion 222 and the foot portion 223 connect. Each of the positioning slots 213A, 213B may define a respective entrance 219A defining an entrance length EL and a slide portion 219B defining a slide portion length SPL that is greater than the entrance length EL so the slide portion 219B is longer than the entrance 219A, allowing sliding of the positioning pin 221 across the slide portion length SPL.

At least one of the rails 212A, 212B and the base 211 form at least one cleanout channel 230, illustrated as a single cleanout channel in FIGS. 2-3, therebetween that is configured to receive a cleaning fluid for removing contaminants that collect on the at least one rail 212A, 212B and the base 211. As used herein, a "cleaning fluid" is any type of fluid, e.g., a liquid and/or a gas, that may be utilized to remove contaminants from and/or sterilize the rail assembly 210. Exemplary cleaning fluids include, but are not limited to, fluids that are commonly used to clean and sterilize medial devices such as liquid water, ethanol, detergents, soap, steam, ethylene oxide (ETO), one or more anti-bacterial agents, one or more anti-viral agents, etc. In some embodiments, such as the illustrated embodiment, each of the rails 212A, 212B and the base 211 may form a respective cleanout channel 230 therebetween. It should be appreciated that the cleanout channels 230 may be similarly configured, so further description of one of the cleanout channels 230 is similarly applicable to the other cleanout channel 230. The cleanout channel 230 is sized so cleaning fluid, especially liquids and/or gases at atmospheric pressure, may be received in the cleanout channel 230 to entrain and remove contaminants that collect on the rails 212A, 212B and the base 211. In this respect, the cleanout channel 230 may be sized so there is a gap between the rails 212A, 212B and the base 211 with a channel height CH that is between, for example, 2 mm and 7 mm, to allow insertion of bristles of a cleaning brush into the cleanout channel 230. It should be appreciated that the described channel heights CH are exemplary only, and the cleanout channel 230 may be configured in any manner that allows the cleanout channel 230 to receive a cleaning fluid to remove contaminants that collect on the rails 212A, 212B and the base 211. In some embodiments, the cleanout channel 230 defines a pair of tapered ends, with one such tapered end 218 illustrated in FIG. 3, where the channel height CH changes in order to assist in manufacturing of the rails 212A, 212B. The channel height CH of the cleanout channel 230 may be constant between the tapered ends 218.

In some embodiments, one or both of the rails 212A, 212B, illustrated and described further herein as both of the rails 212A, 212B, includes a pair of longitudinal end portions 214A, 214B at respective longitudinal ends of the rails 212A, 212B. In some embodiments, the longitudinal end portions 214A, 214B are configured as pads of material that couple to the base 211. The longitudinal end portions 214A, 214B are each in contact with the base 211, with the cleanout channel 230 extending between the longitudinal end portions 214A, 214B, i.e., the cleanout channel 230 terminates at the longitudinal end portions 214A, 214B. In some embodiments, the rails 212A, 212B do not contact the base 211 other than at the longitudinal end portions 214A, 214B, i.e., the longitudinal end portions 214A, 214B define the only portions of the rails 212A, 212B that contact the base 211. By limiting contact between the rails 212A, 212B and the base 211 to the longitudinal end portions 214A, 214B, there are few small, irregularly located crevices where contaminants can collect.

Referring specifically to FIG. 3, it can be seen that the rail assembly 210 may include a pair of fasteners, with only one fastener 231 illustrated in FIG. 3. Each of the fasteners 231 affixes a respective one of the longitudinal end portions 214A, 214B to the base 211. As illustrated in FIG. 3, for example, the fasteners 231 may be screws that thread into openings 215, 216 of the base 211 and longitudinal end portions 214A, 214B, respectively. Each of the fasteners 231 may be configured to compress a surface 217 of its respective longitudinal end portion 214A, 214B against the base 211 such that the longitudinal end portions 214A, 214B are in liquid-tight engagement with the base 211. As used herein, "liquid-tight engagement" should be understood to mean that the surface 217 and the base 211 are compressed together so tightly that liquid water at atmospheric pressure is incapable of infiltrating the region between the base 211 and the compressed surface 217 of the longitudinal end portions 214A, 214B. By tightly affixing the longitudinal end portions 214A, 214B to the base 211, the number of possible small regions where contaminants can collect is significantly reduced, which can make it easier to clean and sterilize the rail assembly 210.

The rails 212A, 212B each define a total rail length RL, which may be the same for both of the rails 212A, 212B. Each of the longitudinal end portions 214A, 214B may define a respective portion length PL1, PL2 that is considerably smaller than the total rail length RL. For example, each of the portion lengths PL1, PL2 may be no more than 5% of the total rail length RL so the rails 212A, 212B only contact the base 211 along 15% of the total rail length RL. In some embodiments, each of the longitudinal end portions 214A, 214B defines a respective surface area that represents no more than 10% of the total surface area of the bottom of its respective rail 212A, 212B. It should be appreciated that the portion lengths PL1, PL2 of the longitudinal end portions 214A, 214B may be smaller than 10% of the total rail length RL; for example, the portion lengths PL1, PL2 of the longitudinal end portions 214A, 214B may be no more than 5% of the total rail length RL. Keeping the length of the longitudinal end portions 214A, 214B, which may be the only portions of the rails 212A, 212B in contact with the base 211, as a relatively low percentage of the total rail length RL reduces the availability of crevices for contaminants to collect.

Previous attempts at producing easily cleaned, modular rail assemblies for knee positioning systems have focused on tightly fixing the entire rail to the base to minimize the number of opportunities for contaminants to collect on the rails and base. While this has been somewhat effective, it has been found to be inevitable that crevices will eventually form between the rails and the base due to, for example, loosening of the connection between the rails and the base as well as deviations from planarity of the rails and base. The rail assembly 210 provided according to the present invention, on the other hand, addresses this problem in a contrary fashion by purposefully providing a cleanout channel 230 representing an area where contaminants will tend to collect but can be easily cleaned by receiving cleaning fluids and/or brush bristles to remove the collected contaminants. Due to the size of the cleanout channel 230, any collected contaminants can be readily seen and exposed to cleaning fluid(s), which clean the contaminants from the cleanout channel 230. Further, the rails 212A, 212B may have limited contact with the base 211 at the longitudinal end portions 214A, 214B, which can be very tightly coupled to the base 211 so contaminants are unlikely to readily collect between the longitudinal end portions 214A, 214B and the base 211. It has been found that providing limited contact between the rails 212A, 212B and the base 211 can reduce the total volume of small crevices between the rails 212A, 212B and the base 211 by over 90% compared to similar modular rail assemblies that lack a cleanout channel. The rails 212A, 212B may also be coupled to the base 211 by a pair of fasteners 231, which can be quickly and easily removed to uncouple the rails 212A, 212B from the base 211 in case more thorough cleaning is desired. Thus, the rail assembly 210 provided according to the present invention can be easily cleaned and sterilized between procedures for re-use.

Figure 4:
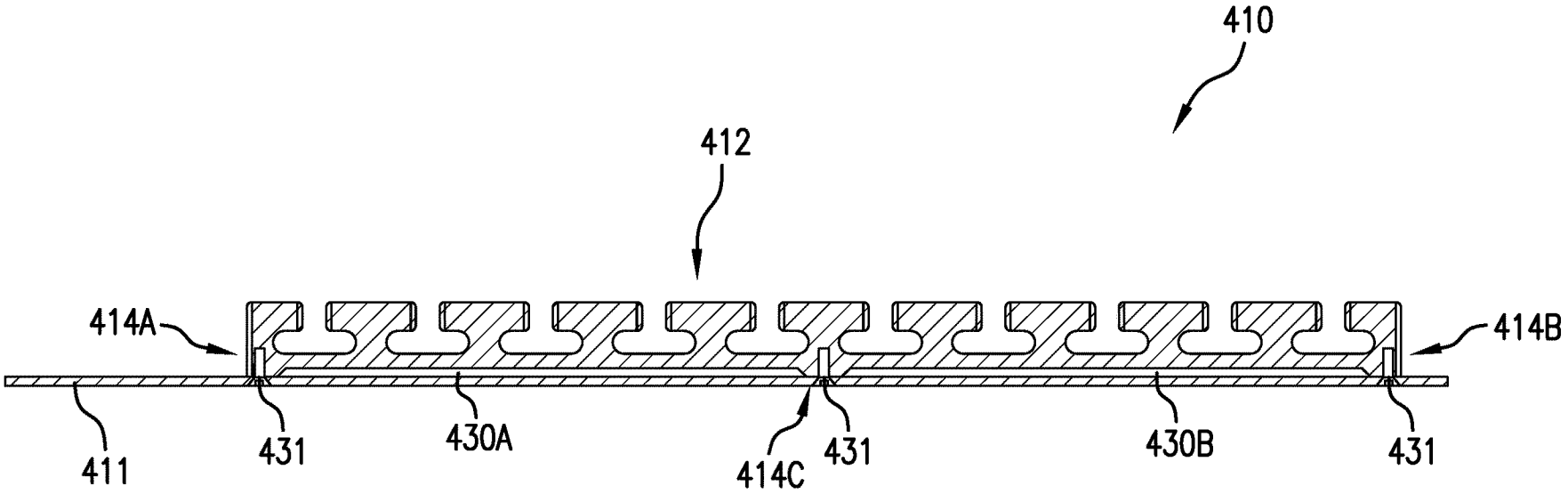
FIG. 4 is a cross-sectional view of another exemplary embodiment of a rail assembly that includes two cleanout channels, provided in accordance with the present invention.

In some embodiments, and referring now to FIG. 4, a rail assembly 410 is provided that is similar to the previously described rail assembly 210 but includes a pair of rails 412 (only one such rail is illustrated in FIG. 4) that are each removably coupled to a base 411 and include multiple cleanout channels 430A, 430B. The rails 412 may each include a pair of longitudinal end portions 414A, 414B, which may be configured as pads of material coupled to the base 411, as well as a middle pad 414C disposed between the longitudinal end portions/pads 414A, 414B. The middle pad 414C may be generally equidistant from each of the longitudinal end pads 414A, 414B so each of the cleanout channels 430A, 430B have an equal channel length, as illustrated, or may be closer to one of the end pads 414A, 414B, if desired, to form cleanout channels 430A, 430B with different channel lengths. Each of the cleanout channels 430A, 430B may be defined between a respective longitudinal end portion 414A, 414B and the middle pad 414C. A fastener 431, such as a screw, may be used to removably couple each pad 414A, 414B, 414C to the base 411 in a liquid-tight manner, similar to the previously described rails 212A, 212B, to reduce the risk of contaminants and/or pathogens accumulating in crevices formed between the pads 414A, 414B, 414C and the base 411. In other respects, the rail assembly 410 may be similar to the previously described rail assembly 210. It should thus be appreciated that rail assemblies provided according to the present disclosure may include more than one cleanout channel formed between the rail and the base.

Figure 5:
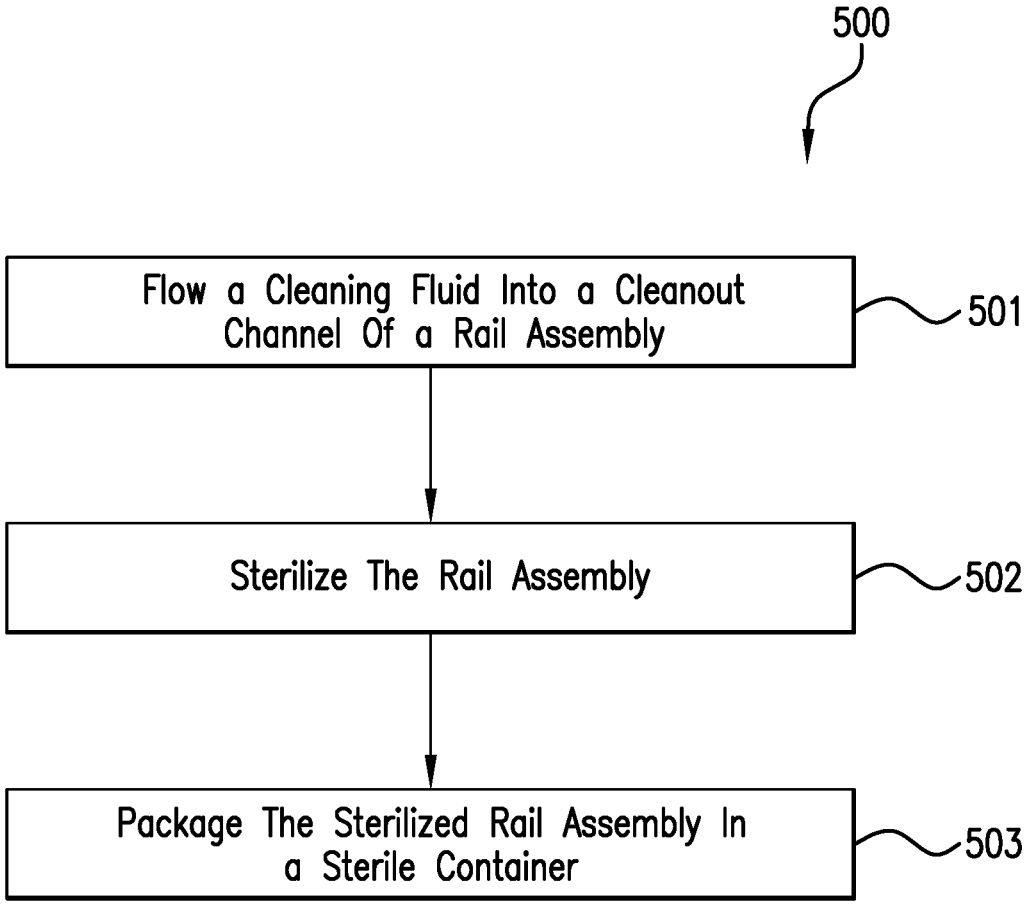
FIG. 5 is a flow chart illustrating an exemplary embodiment of a method of cleaning a rail assembly, provided in accordance with the present invention.

In some embodiments, and referring now to FIG. 5, a method 500 of cleaning a rail assembly, such as the previously described rail assemblies 210, 410, is provided. The method 500 includes flowing 501 a cleaning fluid into a cleanout channel 230, 430A, 430B defined between at least one rail 212A, 212B, 412 and a base 211, 411 of the rail assembly 210, 410. In some embodiments, the cleaning fluid comprises at least one of the following fluids: water, ethanol, detergent, soap, steam, and ETO. The cleaning fluid may flow 501 into the cleanout channel 230, 430A, 430B at atmospheric pressure or, in some embodiments, may be pressurized above atmospheric pressure to wash off contaminants. The rail assembly 210, 410 may also be scrubbed with, e.g., a bristle brush, including in the cleanout channel 230, 430A, 430B, to remove collected contaminants and/or pathogens. The rail assembly 210, 410 may be sterilized 502 to kill pathogens on the rail assembly 210, 410. In some embodiments, sterilizing 502 the rail assembly 210, 410 includes subjecting the rail assembly 210, 410 to high temperature and pressure, i.e., autoclaving, irradiating the rail assembly 210, 410, and/or contacting the rail assembly 210, 410 with a sterilizing agent such as ETO. In some embodiments, the rail assembly 210, 410 is dissembled prior to sterilization 502 by uncoupling the rails 212A, 212B, 412 from the base 211, 411. After sterilization 502, the sterile rail assembly 210, 410 may be packaged 503 in a sterile container, such as a sterile bag, and delivered to a healthcare provider.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rail assembly for a knee positioning system, comprising:

a base;

a pair of rails removably fastened to the base, each of the rails defining a plurality of positioning slots formed therein, each of the positioning slots being at least partially aligned with a corresponding positioning slot of the other rail, at least one of the rails and the base forming at least one cleanout channel therebetween that is configured to receive a cleaning fluid for removing contaminants that collect on the at least one rail and the base, wherein the at least one cleanout channel comprises an opening formed in a bottom of the at least one rail that is opposite a side of the at least one rail in which the positioning slots are formed, wherein the at least one rail includes a pair of longitudinal end portions in contact with the base, the at least one cleanout channel extending between the longitudinal end portions, wherein the at least one rail does not contact the base other than at the longitudinal end portions; and at least one pair of fasteners, each of the fasteners removably affixing a respective one of the longitudinal end portions to the base.

2. The rail assembly of claim 1, wherein each of the fasteners is configured to compress a surface of its respective longitudinal end portion against the base such that the longitudinal end portions are in liquid-tight engagement with the base.

3. The rail assembly of claim 1, wherein the at least one rail defines a total rail length and each of the longitudinal end portions defines a respective portion length that is no more than 5% of the total rail length.

4. The rail assembly of claim 1, wherein the at least one cleanout channel comprises a pair of ends and defines a constant height between the pair of ends.

5. The rail assembly of claim 1, wherein the rails extend in parallel with each other.

6. The rail assembly of claim 5, wherein each of the positioning slots defines an entrance and a slide portion that is longer than the entrance.

7. A knee positioning system, comprising:

a rail assembly comprising:

a base;

a pair of rails removably fastened to the base, each of the rails defining a plurality of positioning slots formed therein, each of the positioning slots being at least partially aligned with a corresponding positioning slot of the other rail, at least one of the rails and the base forming at least one cleanout channel therebetween that is configured to receive a cleaning fluid for removing contaminants that collect on the at least one rail and the base, wherein the at least one cleanout channel comprises an opening formed in a bottom of the at least one rail that is opposite a side of the at least one rail in which the positioning slots are formed, wherein the at least one rail includes a pair of longitudinal end portions in contact with the base, the at least one cleanout channel extending between the longitudinal end portions, wherein the at least one rail does not contact the base other than at the longitudinal end portions; and at least one pair of fasteners, each of the fasteners removably affixing a respective one of the longitudinal end portions to the base; and a boot comprising a leg portion, a foot portion coupled to the leg portion, and a positioning pin slidably received in a pair of corresponding positioning slots of the rails.

8. The knee positioning system of claim 7, wherein each of the fasteners is configured to compress a surface of its respective longitudinal end portion against the base such that the longitudinal end portions are in liquid-tight engagement with the base.

9. The knee positioning system of claim 7, wherein the at least one rail defines a total rail length and each of the longitudinal end portions defines a respective portion length that is no more than 5% of the total rail length.

10. The knee positioning system of claim 7, wherein the at least one cleanout channel comprises a pair of ends and defines a constant height between the pair of ends.

11. The knee positioning system of claim 7, wherein the rails extend in parallel with each other.

12. The knee positioning system of claim 11, wherein each of the positioning slots defines an entrance and a slide portion that is longer than the entrance.

* * * * *